US009611983B2

(12) United States Patent
Lorenz et al.

(10) Patent No.: US 9,611,983 B2
(45) Date of Patent: Apr. 4, 2017

(54) LED MODULE AND LUMINAIRE HAVING AN LED MODULE

(71) Applicant: OSRAM GmbH, Munich (DE)

(72) Inventors: Stefan Lorenz, Obertraubling (DE); Antje Graichen, Lappersdorf (DE)

(73) Assignee: OSRAM GmbH, Munich (DE)

( * ) Notice: Subject to any disclaimer, the term of this patent is extended or adjusted under 35 U.S.C. 154(b) by 331 days.

(21) Appl. No.: 14/271,529

(22) Filed: May 7, 2014

(65) Prior Publication Data

US 2014/0334156 A1 Nov. 13, 2014

(30) Foreign Application Priority Data

May 7, 2013 (DE) ..... 10 2013 208 392

(51) Int. Cl.
*H05B 33/08* (2006.01)
*F21K 9/20* (2016.01)

(52) U.S. Cl.
CPC ..... *F21K 9/20* (2016.08); *H05B 33/0806* (2013.01)

(58) Field of Classification Search
CPC ..... F21Y 2101/02; F21Y 2113/005; F21Y 2111/007; F21Y 2103/003; F21S 2/005; F21S 4/28; G09F 9/301; Y02B 20/342; Y10S 362/80; F21K 9/30; F21K 9/20; H05B 33/0806
See application file for complete search history.

(56) References Cited

U.S. PATENT DOCUMENTS

2005/0168156 A1* 8/2005 Li ..... H05B 33/0803 315/185 R
2010/0220479 A1 9/2010 Yamashita et al.
2012/0002407 A1* 1/2012 Li ..... F21V 31/04 362/218

FOREIGN PATENT DOCUMENTS

DE 10051528 A1 5/2002
DE 102009014535 A1 9/2010
EP 2378839 A2 10/2011
WO 2010108751 A1 9/2010

OTHER PUBLICATIONS

English abstract of EP2378839 A2 of Oct. 19, 2011.

(Continued)

*Primary Examiner* — Stephen F Husar
*Assistant Examiner* — Danielle Allen
(74) *Attorney, Agent, or Firm* — Viering, Jentschura & Partner mbB

(57) ABSTRACT

An LED module includes a first and a second partial chain of LEDs, wherein the LED module has a first input terminal and a second input terminal, via which said LED module is connectable to a light emitting diode module connected upstream or to a voltage source, and wherein the LED module has a first output terminal and a second output terminal, via which the LED module is connectable to a LED module connected downstream, a parallel-connecting terminal, which is connectable to the first input terminal for the purpose of connecting the two partial chains in parallel, wherein a first intermediate terminal connected to an output of the first partial chain and a second intermediate terminal connected to an input of the second partial chain are provided, which are connectable to one another for the purpose of connecting the two partial chains in series.

14 Claims, 3 Drawing Sheets

(56) References Cited

OTHER PUBLICATIONS

English abstract of DE 10051528 A1 of May 2, 2002.
Office Action issued in the corresponding German application No. 102013208392.0, dated Dec. 18, 2013.

* cited by examiner

LED MODULE AND LUMINAIRE HAVING AN LED MODULE

CROSS-REFERENCE TO RELATED APPLICATION

This application claims priority to German Patent Application Serial No. 10 2013 208 392.0, which was filed May 7, 2013, and is incorporated herein by reference in its entirety.

TECHNICAL FIELD

Various embodiments relate generally to LED modules having a plurality of light-emitting diodes (LEDs).

BACKGROUND

Various embodiments relate to LED modules having a plurality of LEDs which are connected in series. This applies in particular to linear and planar LED modules. The operating voltage of the LED module is determined by the number of LEDs connected in series.

By way of example, safety extra low voltages (SELV), which are handlable particularly simply, or higher low-voltage ranges (e.g. 70-110 V, designated hereinafter generally as HV), in which particularly efficient power supply units can be designed, are known as advantageous operating voltage ranges for LED modules of this type. One voltage range or the other may be advantageous depending on requirements in respect of the handlability and the efficiency of the LED modules.

In accordance with the prior art, therefore, different LED modules are designed for the different voltage ranges. What is disadvantageous in this case is that different LED modules have to be conceived, constructed and kept in stock.

Furthermore, it is known to design LED modules for the SELV range and to operate a plurality of them in parallel, such that the requirement in respect of the operating voltage does not increase. Alternatively, e.g. two modules conceived for the SELV range are connected in series, and so their total supply voltage lies in the HV range as a result.

What is disadvantageous in this case is that at least two LED modules are required, and that the total number of modules has to be even.

Furthermore, the prior art discloses LED modules which contain a switching logic (e.g. double changeover switch), in order to interconnect LED partial chains of the module either in parallel or in series, such that the module can be operated with parallel-connected partial chains in the SELV range and with series-connected partial chains in the HV range. What is disadvantageous in this case is that the changeover switch requires structural space and causes costs.

SUMMARY

An LED module includes a first and a second partial chain of LEDs, wherein the LED module has a first input terminal and a second input terminal, via which said LED module is connectable to a light emitting diode module connected upstream or to a voltage source, and wherein the LED module has a first output terminal and a second output terminal, via which the LED module is connectable to a LED module connected downstream, a parallel-connecting terminal, which is connectable to the first input terminal for the purpose of connecting the two partial chains in parallel, wherein a first intermediate terminal connected to an output of the first partial chain and a second intermediate terminal connected to an input of the second partial chain are provided, which are connectable to one another for the purpose of connecting the two partial chains in series.

BRIEF DESCRIPTION OF THE DRAWINGS

In the drawings, like reference characters generally refer to the same parts throughout the different views. The drawings are not necessarily to scale, emphasis instead generally being placed upon illustrating the principles of the invention. In the following description, various embodiments of the invention are described with reference to the following drawings, in which.

DESCRIPTION

Figure 1:
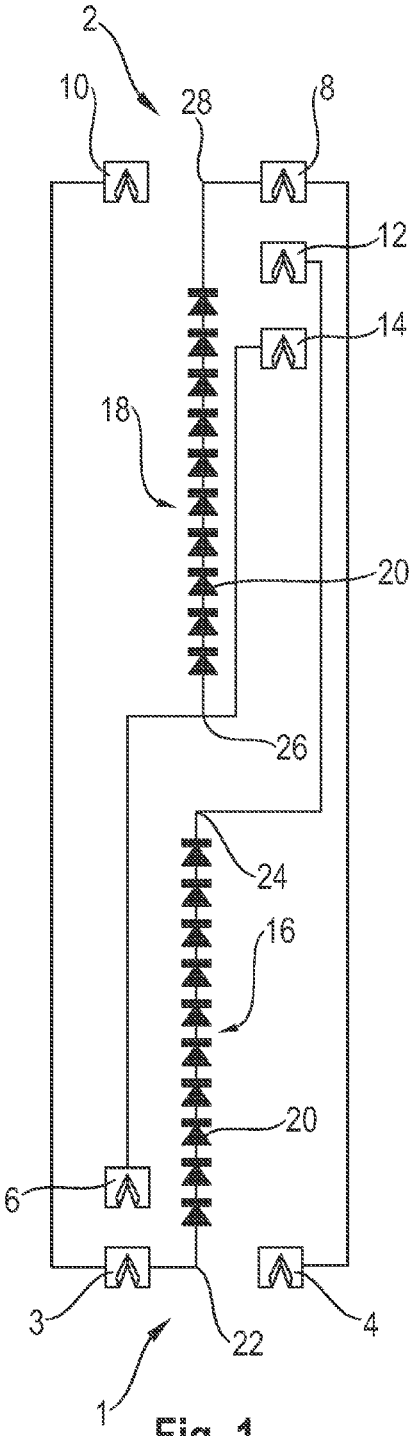
FIG. 1 shows a circuit diagram of an embodiment of the LED module.

The following detailed description refers to the accompanying drawings that show, by way of illustration, specific details and embodiments in which the invention may be practiced.

The word "exemplary" is used herein to mean "serving as an example, instance, or illustration". Any embodiment or design described herein as "exemplary" is not necessarily to be construed as preferred or advantageous over other embodiments or designs.

The word "over" used with regards to a deposited material formed "over" a side or surface, may be used herein to mean that the deposited material may be formed "directly on", e.g. in direct contact with, the implied side or surface. The word "over" used with regards to a deposited material formed "over" a side or surface, may be used herein to mean that the deposited material may be formed "indirectly on" the implied side or surface with one or more additional layers being arranged between the implied side or surface and the deposited material.

Various embodiments provide a light emitting diode (LED) module which can be installed and utilized structurally identically for use in the low voltage range (SELV range) and in a medium voltage range (HV) range and is thus universally usable. In this case, the costs are intended to be minimized.

Furthermore, various embodiments provide a luminaire having LED modules of this type.

Various embodiments provide an LED module having a first and a second partial chain of LEDs. The LED module has a first input terminal and a second input terminal, which are embodied in such a way that the LED module can be connected via them to a voltage source or, if the LED module according to various embodiments is intended to be part of a stringing-together of a plurality of LED modules, to an LED module connected upstream. Furthermore, the LED module has a first output terminal and a second output terminal, which are embodied in such a way that the LED module can be connected via them to an LED module connected downstream, if the LED module according to various embodiments is intended to be part of a stringing-together of a plurality of LED modules. According to various embodiments, the LED module has a parallel-connecting terminal, which can be connected to the first input terminal for the purpose of connecting in parallel its two partial chains formed from LEDs. According to various embodiments, the LED module furthermore has a first intermediate terminal connected to an output of its first partial chain formed from LEDs and a second intermediate terminal connected to an input of its second partial chain formed from LEDs, which intermediate terminals can be connected to one another for the purpose of connecting the two partial chains in series.

Partial chains should be understood here to mean arrangements of series-connected LEDs, e.g. those which can be connected together to form a common chain. Partial chains can be terminated for example by different components than LEDs, different LEDs than the LEDs used in the partial chain, or else terminal locations or nodes.

The voltage of the LED module according to various embodiments can thus be defined in a simple manner during the connection or the wiring of the LED module. In the case of the first variant of the connection or wiring (connection of the partial chains in parallel), the LED module according to various embodiments is suitable for the SELV range, while in the case of the second variant of the connection or wiring (connection of the partial chains in series), it is suitable for the HV range. The LED module according to various embodiments can thus be used structurally identically for the different voltage ranges. A separate switch (incl. setting process) is obviated.

The wiring in accordance with the two variants closes different electric circuits of the LED module. Since LED modules have to be connected anyway during their mounting in a conventional luminaire, the voltage range is simultaneously set by the connection of the LED modules according to various embodiments.

If the first input terminal is connected to the first output terminal and the second output terminal is connected to the second input terminal, the LED module according to various embodiments can also be a first or a central LED module of a stringing-together of a plurality of LED modules of this type. The LED module according to various embodiments can thus be utilized with very high flexibility to form a modular luminaire. In various embodiments, these connections are provided on or in a printed circuit board of the LED module according to various embodiments.

In various embodiments, an input of the first partial chain is connected to the first input terminal, while the output of the first partial chain is connected to the first intermediate terminal. Furthermore, the input of the second partial chain is connected to the parallel-connecting terminal and the second intermediate terminal, while an output of the second partial chain is connected to the second output terminal. In various embodiments, these connections are provided on or in the printed circuit board of the LED module according to various embodiments.

In various embodiments of the LED module, the LED module has a first input-side terminal region, in which the first input terminal and the second input terminal and the parallel-connecting terminal are grouped. The parallel-connecting terminal is thus arranged in the vicinity of the first input terminal, with the result that a connection of these two terminals for the purpose of connecting the partial chains in parallel is simplified.

In various embodiments of the LED module, the LED module has a second output-side terminal region, in which the first output terminal and the second output terminal and the two intermediate terminals are grouped. The second and e.g. the first intermediate terminals are thus arranged in the vicinity of the second output terminal, with the result that a connection of the second intermediate terminal to the second output terminal for the purpose of connecting the partial chains in parallel is simplified.

In this case, it may be provided that if the first intermediate terminal is arranged between the second output terminal and the second intermediate terminal. In this regard, the two intermediate terminals are also arranged adjacent to one another and can be connected to one another in a simple manner for connecting the partial chains in series.

In various embodiments, the LED module has an elongate, e.g. approximately rectangular printed circuit board. The two terminal regions can then be arranged at short edges of the printed circuit board, said edges being situated opposite one another, as a result of which LED modules of this type are well suited to forming a stringing-together with comparatively short connecting lines.

In various embodiments, the parallel-connecting terminal is arranged adjacent to the first input terminal at a side of the first input terminal which faces away from the edge of the printed circuit board, and wherein these two terminals lie approximately on a line oriented parallel to a longitudinal axis of the printed circuit board. In that case, in a parallel connection of the partial chains, a substantially straight conducting element—e.g. a wire—can serve for contact-connecting the first input terminal to the parallel-connecting terminal.

In various embodiments, the two intermediate terminals are arranged adjacent to the second output terminal at a side of the second output terminal which faces away from the edge of the printed circuit board, wherein these three terminals lie approximately on a line oriented parallel to a longitudinal axis of the printed circuit board. In this case—as viewed from the edge—the second output terminal should be arranged first, then the first intermediate terminal and finally the second intermediate terminal. In that case, in a parallel connection of the partial chains, a substantially straight conducting element—e.g. a wire—can serve for contact-connecting the first intermediate terminal to the second output terminal. In a series connection of the partial chains, moreover, a substantially straight conducting element—in particular a short wire—can serve for contact-connecting (bridging) the two intermediate terminals.

In this case, it may be provided that if the LED module according to various embodiments includes the three last-mentioned developments, and if the two virtual lines lie on both sides of the longitudinal axis and are at an identical distance from the longitudinal axis. In that case, a plurality of LED modules of this type can be arranged in a series and only straight connecting lines of minimal length are necessary.

In various embodiments, the terminals are insulation displacement terminal contacts. In that case, the connecting lines are mountable in a simple manner.

The luminaire according to various embodiments has at least two LED modules described above, of which a first LED module is connected upstream (with respect to a stringing-together) and a second LED module is connected downstream (with respect to the stringing-together). The first input terminal and the second input terminal of the first LED module are connected to a voltage source.

In accordance with a first variant of the luminaire according to various embodiments, the partial chains of the LED modules are connected in parallel. For this purpose, the connecting line between the voltage source and the first input terminal is lengthened as far as the parallel-connecting terminal. For this purpose, furthermore, the first output terminal of the first LED module is connected to the first input terminal and the parallel-connecting terminal of the second LED module, and the second input terminal of the second LED module is connected to the second output terminal and the first intermediate terminal of the first LED module.

In this case, in the case of the last LED module of the stringing-together, the first intermediate terminal of said module is connected to the second output terminal of said module.

In accordance with a second variant of the luminaire according to various embodiments, the partial chains of the LED modules are connected in series. For this purpose, the first output terminal of the first LED module is connected to the first input terminal of the second LED module, and the second input terminal of the second LED module is connected to the second output terminal of the first LED module. The two intermediate terminals of each LED module are connected to one another.

FIG. 1 shows a circuit diagram of an embodiment of the LED module according to various embodiments. It has a first terminal region 1 and a second terminal region 2. A first input terminal 3, a second input terminal 4 and a parallel-connecting terminal 6 are grouped in the first terminal region 1. A second output terminal 8, a first output terminal 10, a first intermediate terminal 12 and a second intermediate terminal 14 are grouped in the second terminal region 2.

The LED module has a first partial chain 16 and a second partial chain 18. Both partial chains 16, 18 consist of a plurality of series-connected LEDs 20. In this case, an input 22 of the first partial chain 16 is connected to the first input terminal 3, while an output 24 of the first partial chain 16 is connected to the first intermediate terminal 12. An input 26 of the second partial chain 18 is connected to the parallel-connecting terminal 6, on the one hand, and to the second intermediate terminal 14, on the other hand. An output terminal 28 of the second partial chain 18 is connected to the second output terminal 8.

Furthermore, the first input terminal 3 is connected to the first output terminal 10 and the second output terminal 8 is connected to the second input terminal 4.

Figure 2:
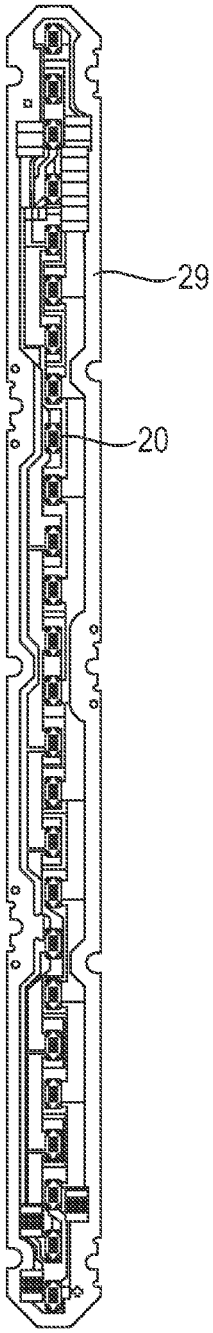
FIG. 2 shows a printed circuit board of the embodiment in accordance with FIG. 1 in a plan view.

FIG. 2 shows an elongate printed circuit board 29 of the exemplary embodiment in accordance with FIG. 1. It can be discerned here that all LEDs 20 of both partial chains 16, 18 are arranged at uniform distances with respect to one another and in a series centrally on the printed circuit board 29.

Figure 3:
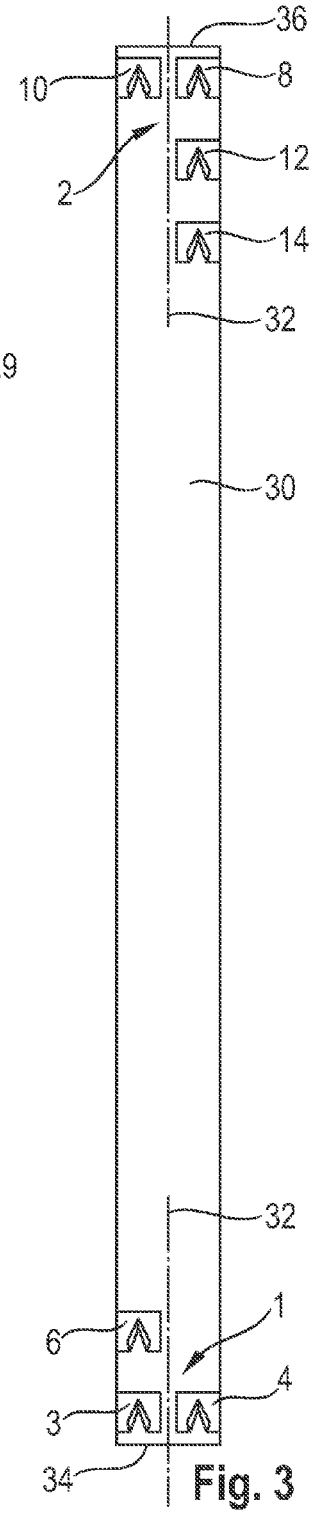
FIG. 3 shows the printed circuit board of the embodiment in accordance with FIG. 1 in a schematic illustration.

FIG. 3 shows an underside of the printed circuit board 29 of the LED module in accordance with FIGS. 1 and 2. The printed circuit board 29 has the shape of an elongate rectangle, a center axis or longitudinal axis 32 being depicted in FIG. 3. The terminals 3, 4, 6, 8, 10, 12, 14 described in FIG. 1 are fixed to the underside of the printed circuit board 29 and embodied as insulation displacement terminal contacts. In this case, as viewed from a short edge 34 of the printed circuit board 29, the first input terminal 3 and the parallel-connecting terminal 6 are arranged one behind the other and in this case parallel to the longitudinal axis 32. In a fundamentally comparable manner, as viewed from a short edge 36 of the printed circuit board 29, the second output terminal 8, the first intermediate terminal 12 and the second intermediate terminal 14 are arranged one behind another and in this case parallel to the longitudinal axis 32.

Figure 4:
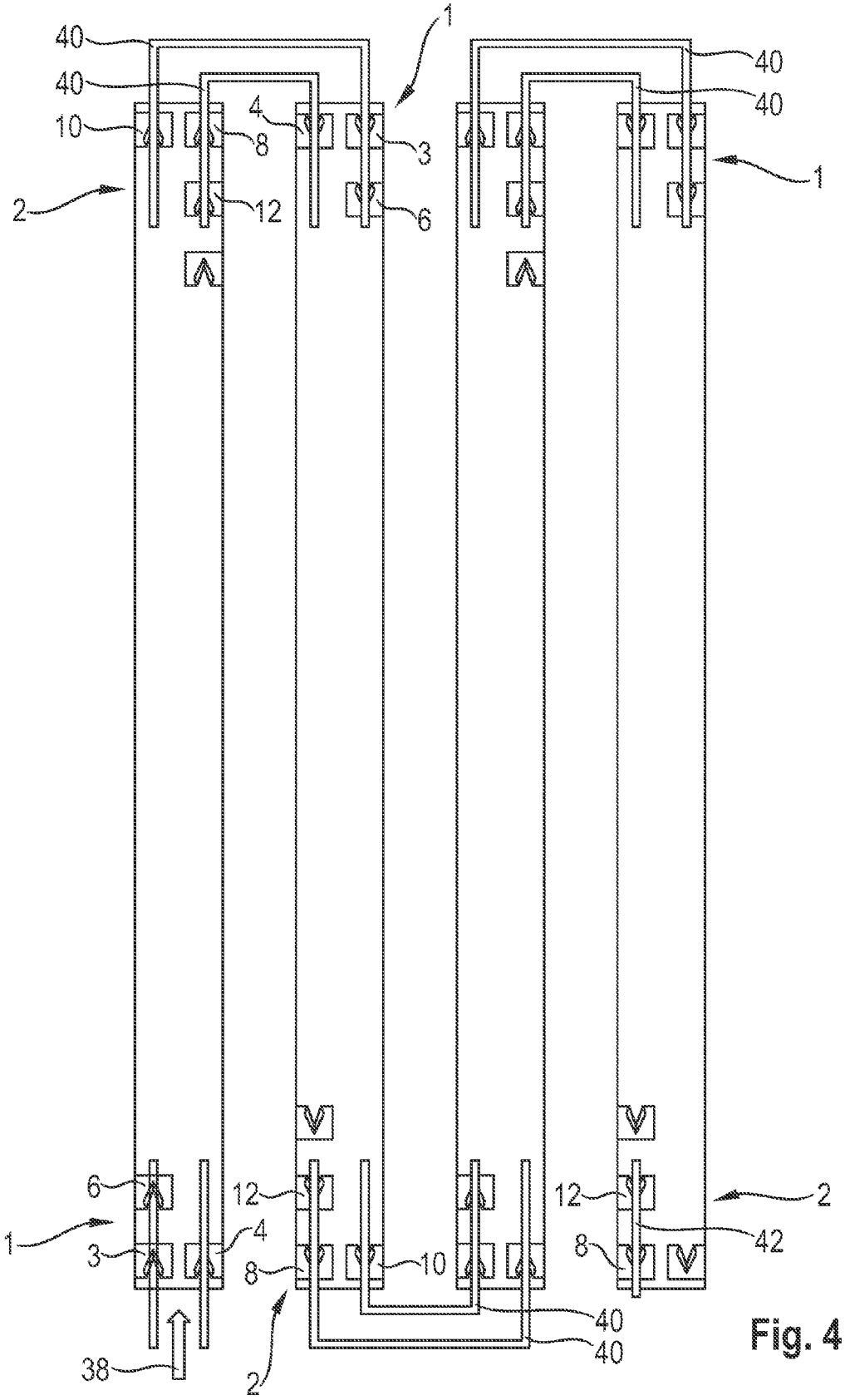
FIG. 4 shows a first embodiment of a luminaire including a plurality of LED modules in accordance with FIG. 1.

FIG. 4 shows a stringing-together of four LED modules in accordance with FIG. 1 to FIG. 3. In this case, the LED module arranged on the left in FIG. 4 is the first LED module of the stringing-together and is supplied, by means of a voltage source symbolized by an arrow 38, with voltage on the one hand between the first input terminal 3 and the parallel-connecting terminal 6 and on the other hand the second input terminal 4.

In the region of its second terminal region 2, the first LED module is connected to the first terminal region 1 of the second LED module via two connecting wires 40. In this case, the first output terminal 10 of the first LED module is connected to the first input terminal 3 and the parallel-connecting terminal 6 of the second LED module via a connecting wire 40. The second input terminal 4 of the second LED module is connected to the second output terminal 8 and the first intermediate terminal 12 of the first LED module via a further connecting wire 40.

In the manner described above, the third LED module is also connected to the second LED module, and the fourth LED module to the third LED module. In the second terminal region 2 of the last LED module (bottom right in the figure), a short connecting wire 42 is provided between the second output terminal 8 and the first intermediate terminal 12.

By means of the arrangement of the connecting wires 40, 42 as shown in FIG. 4, the four LED modules shown are firstly strung together, such that the respective partial chains 16, 18 (cf. FIG. 1) of all four LED modules are supplied via the voltage source 38. Furthermore, the two partial chains 16, 18 (cf. FIG. 1) of each LED module are connected in parallel with one another by the respective connection of the second output terminal 8 to the first intermediate terminal 12. As a result, each LED module is configured for comparatively low voltage (low voltage/safety extra low voltage/SELV).

Figure 5:
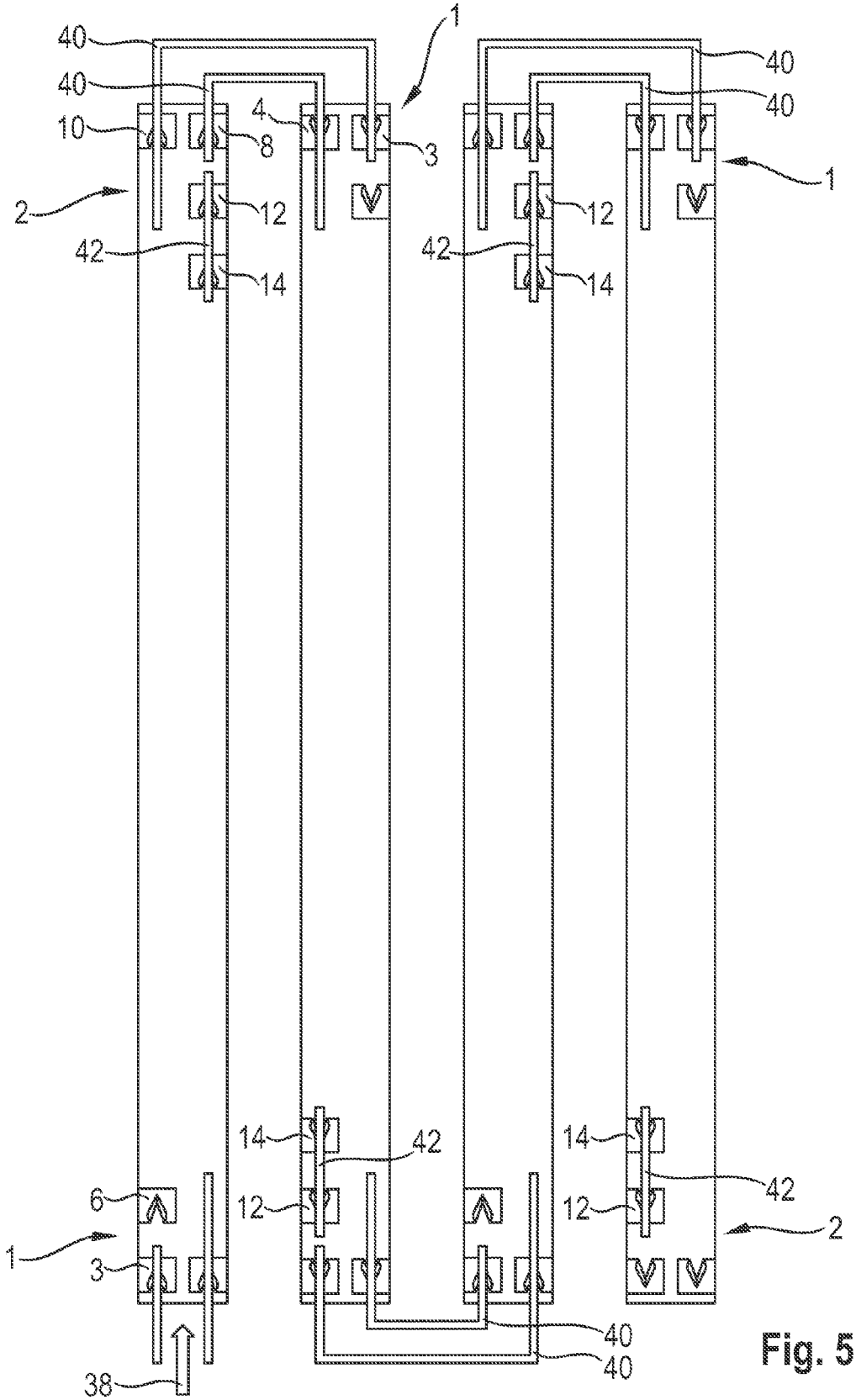
FIG. 5 shows a second embodiment of a luminaire including a plurality of LED modules in accordance with FIG. 1.

FIG. 5 likewise shows four LED modules in accordance with FIG. 1 to FIG. 3, which are strung together in such a way that they form a luminaire. In this case, the connecting wires 40, 42 are arranged in such a way that the partial chains 16, 18 (cf. FIG. 1) of each LED module are connected in series with one another. Thus, all partial chains 16, 18 of the entire luminaire are connected in series. In a departure from the luminaire shown in FIG. 4, the first input terminal 3 of each LED module is not connected to the adjacent parallel-connecting terminal 6, and so the respective parallel-connecting terminal 6 remains without contact-connection. Furthermore, the second output terminal 8 of each LED module is not connected to the adjacent first intermediate terminal 12. Instead, the first intermediate terminal 12 of each LED module is connected to the adjacent second intermediate terminal 14. This is done via a respective short connecting wire 42.

In both embodiments of the luminaire, the production of the connections by means of the connecting wires 40, 42 to all the terminals 3, 4, 6, 8, 10, 12, 14 is simplified by all the terminals 3, 4, 6, 8, 10, 12, 14 being embodied as insulation displacement terminal contacts, such that the respective connecting wire 40, 42 can be clamped in without a further tool in a simple manner. Therefore, according to various embodiments, by means of the work step "connecting LED modules", the configuration of the LED modules is possible at the same time.

In a departure from the luminaires shown in FIG. 4 and FIG. 5, the LED modules can also be arranged in a long series along a common longitudinal axis, thus resulting in a chain of lights instead of the compact arrangement.

LIST OF REFERENCE SIGNS

1 first terminal region
2 second terminal region
3 first input terminal
4 second input terminal
6 parallel-connecting terminal
8 second output terminal
10 first output terminal
12 first intermediate terminal
14 second intermediate terminal
16 first partial chain
18 second partial chain
20 LED
22 input
24 output
26 input
28 output
29 printed circuit board
32 longitudinal axis
34 edge
36 edge
38 arrow/voltage source
40 connecting wire
42 short connecting wire While the invention has been particularly shown and described with reference to specific embodiments, it should be understood by those skilled in the art that various changes in form and detail may be made therein without departing from the spirit and scope of the invention as defined by the appended claims. The scope of the invention is thus indicated by the appended claims and all changes which come within the meaning and range of equivalency of the claims are therefore intended to be embraced.

What is claimed is:

1. A light emitting diode module comprising:

a first and a second partial chain of light emitting diodes, wherein each said partial chain is a chain of series connected light emitting diodes, a first input terminal and a second input terminal, via which said light emitting diode module is connectable to a light emitting diode module connected upstream or to a voltage source, a first output terminal and a second output terminal, via which the light emitting diode module is connectable to a light emitting diode module connected downstream, a first and second intermediate terminal, which are connectable to one another to connect the first and second partial chains of light emitting diodes to one another in series, a parallel-connecting terminal, which is connectable to the first input terminal for the purpose of connecting the first and second partial chains of light emitting diodes in parallel.

2. The light emitting diode module of claim 1, wherein the first input terminal is connected to the first output terminal and wherein the second output terminal is connected to the second input terminal.

3. The light emitting diode module of claim 1, wherein an input of the first partial chain is connected to the first input terminal, and wherein the output of the first partial chain is connected to the first intermediate terminal, and when the input of the second partial chain is connected to the parallel-connecting terminal and the second intermediate terminal, and wherein an output of the second partial chain is connected to the second output terminal.

4. The light emitting diode module of claim 1, wherein the first input terminal and the second input terminal and the parallel-connecting terminal are grouped in a first terminal region.

5. The light emitting diode module of claim 1, wherein the first output terminal and the second output terminal and the two intermediate terminals are grouped in a second terminal region.

6. The light emitting diode module of claim 1, wherein the first intermediate terminal is arranged between the second output terminal and the second intermediate terminal.

7. The light emitting diode module of claim 4, wherein the first output terminal and the second output terminal and the two intermediate terminals are grouped in a second terminal region;

the light emitting diode module further comprising an elongate printed circuit board, wherein the two terminal regions are arranged adjacent to respective short edges of the printed circuit board, said edges being situated opposite one another.

8. The light emitting diode module of claim 7, wherein the parallel-connecting terminal is arranged adjacent to the first input terminal at a side of the first input terminal which faces away from the edge of the printed circuit board, and wherein these two terminals lie approximately on a first line oriented parallel to a longitudinal axis of the printed circuit board.

9. The light emitting diode module of claim 7, wherein the two intermediate terminals are arranged adjacent to the second output terminal at a side of the second output terminal which faces away from the edge of the printed circuit board, and wherein said two intermediate terminals and said second output terminal lie approximately on a second line oriented parallel to a longitudinal axis of the printed circuit board.

10. The light emitting diode module of claim 8, wherein the two lines lie on both sides of the longitudinal axis and are at an identical distance from the longitudinal axis.

11. The light emitting diode module of claim 1, wherein the terminals are insulation displacement terminal contacts.

12. A luminaire, comprising:

at least a first light emitting diode module and a second light emitting diode module, each light emitting diode module comprising:

a first and a second partial chain of light emitting diodes, wherein each said partial chain is a chain of series connected light emitting diodes, a first input terminal and a second input terminal, via which said light emitting diode module is connectable to a light emitting diode module connected upstream or to a voltage source, a first output terminal and a second output terminal, via which the light emitting diode module is connectable to a light emitting diode module connected downstream, a first and second intermediate terminal, which are connectable to one another to connect the first and second partial chains of light emitting diodes to one another in series, a parallel-connecting terminal, which is connectable to the first input terminal for the purpose of connecting the first and second partial chains of light emitting diodes in parallel wherein the first output terminal of the first light emitting diode module is connected to the first input terminal and the parallel-connecting terminal of the second light emitting diode module, and wherein the second input terminal of the second light emitting diode module is connected to the second output terminal and the first intermediate terminal of the first light emitting diode module.

13. The luminaire of claim 12, further comprising:

a last light emitting diode module, comprising:

a first and a second partial chain of light emitting diodes, wherein each said partial chain is a chain of series connected light emitting diodes, a first input terminal and a second input terminal, via which said light emitting diode module is connectable to a light emitting diode module connected upstream or to a voltage source, a first output terminal and a second output terminal, via which the light emitting diode module is connectable to a light emitting diode module connected downstream, a first and second intermediate terminal, which are connectable to one another to connect the first and second partial chains of light emitting diodes to one another in series, a parallel-connecting terminal, which is connectable to the first input terminal for the purpose of connecting the first and second partial chains of light emitting diodes in parallel the first intermediate terminal of which is connected to the second output terminal.

14. A luminaire comprising:

at least a first light emitting diode module and a second light emitting diode module, each light emitting diode module comprising:

a first and a second partial chain of light emitting diodes, wherein each said partial chain is a chain of series connected light emitting diodes, a first input terminal and a second input terminal, via which said light emitting diode module is connectable to a light emitting diode module connected upstream or to a voltage source, a first output terminal and a second output terminal, via which the light emitting diode module is connectable to a light emitting diode module connected downstream, a first and second intermediate terminal, which are connectable to one another to connect the first and second partial chains of light emitting diodes to one another in series, a parallel-connecting terminal, which is connectable to the first input terminal for the purpose of connecting the first and second partial chains of light emitting diodes in parallel wherein the first output terminal of the first light emitting diode module is connected to the first input terminal of the second light emitting diode module, and wherein the second input terminal of the second light emitting diode module is connected to the second output terminal of the first light emitting diode module, and wherein the two intermediate terminals of each light emitting diode module are connected to one another.

* * * * *